United States Patent [19]

Stolkin et al.

[11] 4,012,996

[45] Mar. 22, 1977

[54] APPARATUS FOR FOLDING AND COMPRESSION OF CORRUGATED CONTAINER BLANKS

[75] Inventors: Walter J. Stolkin, Chicago; William A. Riley, Woodridge, both of Ill.; Henry J. Sejda, Munster, Ind.

[73] Assignee: Stolmar Corporation, Chicago, Ill.

[22] Filed: May 9, 1975

[21] Appl. No.: 576,095

[52] U.S. Cl. ..... 93/36.3; 93/49 R; 93/52

[51] Int. Cl.[2] ..... B31B 1/58

[58] Field of Search ..... 93/52, 49 R, 36.3, 46, 93/50

[56] References Cited

UNITED STATES PATENTS

| | | | |
|---|---|---|---|
| 1,104,013 | 7/1914 | Staude | 93/52 |
| 1,316,120 | 9/1919 | Sutherland | 93/52 X |
| 2,637,251 | 5/1953 | Spiess | 93/49 R |
| 2,896,517 | 7/1959 | Labombarde | 93/49 R |
| 2,911,889 | 11/1959 | Welsh | 93/52 X |
| 2,986,078 | 5/1961 | Hottendorf | 93/49 R |

*Primary Examiner*—James F. Coan
*Attorney, Agent, or Firm*—McDougall, Hersh & Scott

[57] ABSTRACT

Apparatus is disclosed for folding and compressing corrugated container blanks to which adhesive has been applied. The apparatus effects the formation of the completed container by folding the blank and subsequently compressing and maintaining it in the compressed position until the adhesive sets. The apparatus includes a conveyor and rail mechanism for folding the blanks, a center compression unit for compressing the central portion of the blank, a side compression unit for compressing the side portions of the blank, skate wheel rollers for maintaining compression, and a spring-loaded hold-down conveyor for accumulating the completed containers.

10 Claims, 22 Drawing Figures

52
54
56
58
78
86
88
90
92
92a
94
96
100
102
104
106
108
110
120

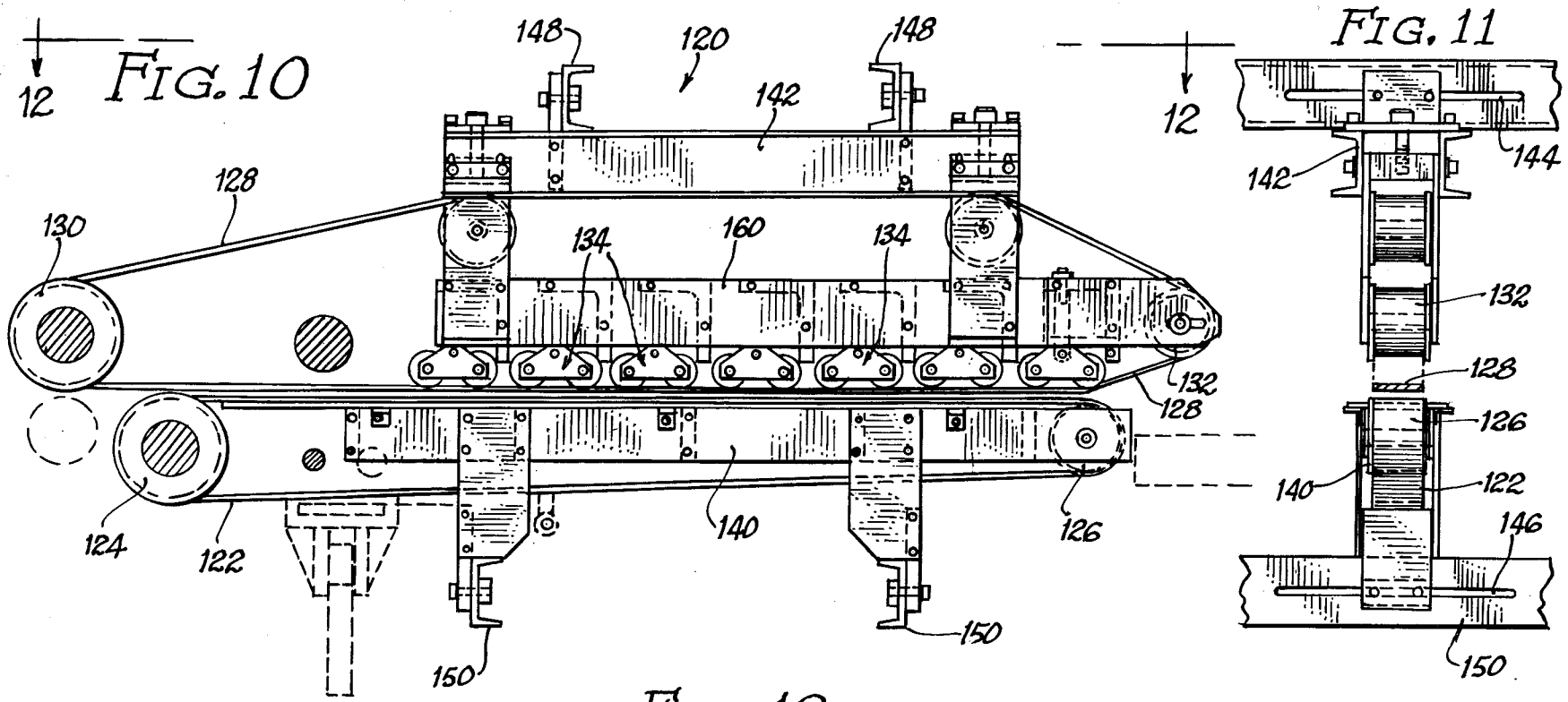
FIG. 11
FIG. 10
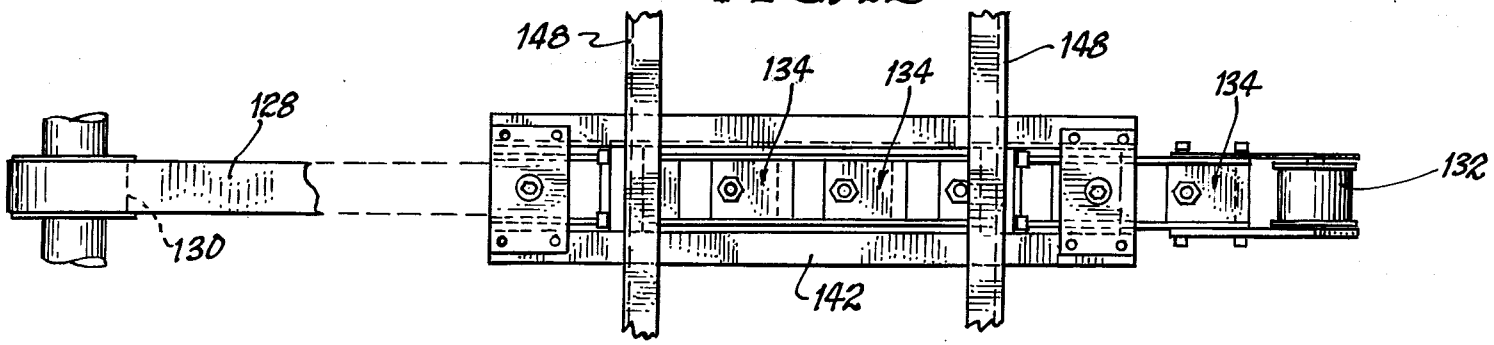
FIG. 12

APPARATUS FOR FOLDING AND COMPRESSION OF CORRUGATED CONTAINER BLANKS

BACKGROUND OF THE INVENTION

This invention relates to the field of machinery for the production of paper containers. More specifically, it relates to machinery for the production of corrugated paper cartons as, for example, the type known in the industry as a regular slotted carton.

The present invention relates to machinery which is employed in conjunction with other box-making devices to form the completed carton. The present invention takes a corrugated carton blank which has been cut and scored as necessary by preceding machinery and to which glue has been applied at appropriate locations on the blank and folds the blank along the score lines, bringing the glue-bearing portions into contact with the glue-receiving portions of the blank. Subsequent to the folding, compression of the blank for a requisite period of time permits the adhesive to set thereby permanently bonding the blank in its assembled condition.

While the equipment disclosed, according to the present invention, can be utilized for the production of many types of corrugated cartons, it has particular use in the production of corrugated cartons which utilize an automatic bottom of the type designed by Stolmar Corporation of Chicago, Illinois. By "automatic bottom" it is meant that the finished carton is maintained in a flat condition until it is desired to use the carton. Pressure is then applied to its edges to form a rectangular enclosure at which point, due to the application of glue to specific portions of the bottom flaps, the bottom is automatically pulled into the deployed position. Further details relative to automatic cartons and apparatus for producing same are contained in the following U.S. patents and patent applications:

U.S. Pat. No. 3,884,130;

U.S. Application Ser. No. 505,451 and Ser. No. 523,996, assigned to the present assignee and incorporated herein by reference.

OBJECTS OF THE INVENTION

It is an object of the invention to provide apparatus for automatically folding carton blanks into their assembled position and for compressing the cartons in such assembled position to spread applied adhesive on said blanks.

It is another object of the invention to provide automatic high-speed equipment that will compress folded blanks for a time sufficient to allow adhesive to set.

It is a further object of the invention to provide equipment for stacking finishing cartons.

Other objects and advantages of the invention will appear more fully in the concluding portion of this specification.

BRIEF DESCRIPTION OF THE DRAWING

FIG. 10 is a side elevational view of the center compression unit of the present invention;

FIG. 11 is an end view of the center compression unit;

FIG. 12 is a plan view taken along the lines 12—12 of FIG. 10;

DETAILED DESCRIPTION

Figure 1:
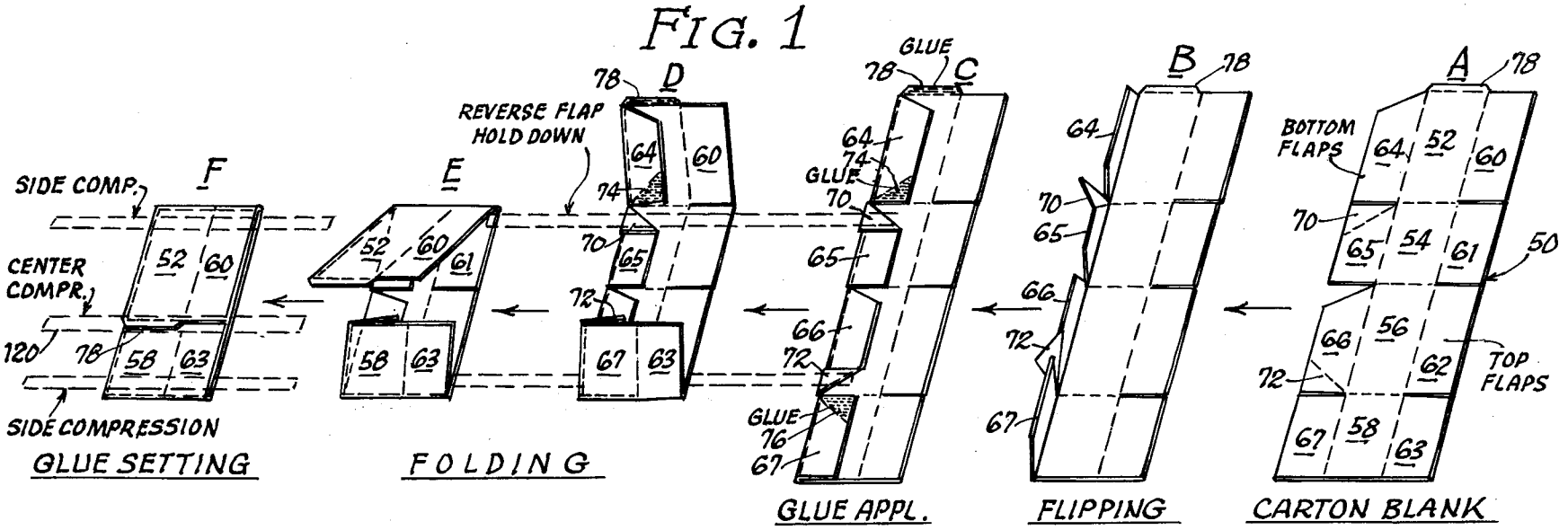
FIG. 1 (A through F) illustrates the effect of the machinery, according to the present invention, upon a corrugated blank.

Referring to FIG. 1, a corrugated carton blank 50 is illustrated. The blank is divided into four panels 52, 54, 56, and 58. Each of the four panels has defined thereon top flaps 60–63 and bottom flaps 64–67. Located on selected ones of the bottom flaps are triangular portions 70 and 72 which are defined by additional score lines. These triangular flaps are folded back onto their respective flaps 65, 66, as the latter are folded over onto the panels 54, 56, as indicated in FIGS. 1-B and 1-C. This sequence is effected by apparatus which forms no part of the present invention and, for example, machinery which will produce this operation is disclosed in U.S. Pat. No. 3,884,130, assigned to the present assignee and incorporated herein by reference.

A regular slotted container (RSC) having an automatic opening bottom, with or without overlap, as illustrated in FIG. 1, will be discussed throughout this application. Nevertheless, other cartons can be processed on the present invention and, for example, RSC's which do not utilize an automatic bottom can be processed.

As illustrated in FIG. 1-C, once the bottom flaps have been folded over onto the panels and the triangular portions reversely folded, glue is applied to the blank as indicated at 74 and 76. It is at this stage in the production of the automatic bottom cartons that the blanks enter the apparatus of the present invention. The present invention serves to complete the production of the box by performing the folding operations illustrated in FIGS. 1-D, 1-E, and 1-F. Specifically, it folds the panels 52 and 58 over onto the panels 54 and 56 to join the manufacturer's flap 78 to the panel 58, and to bring the glue portions 74 and 76 into contact with the reversely folded flaps 70 and 72. Once the blank has been placed in this conditions, it is compressed and maintained that way so that the adhesive can set to permanently secure the blank in its final assembled condition.

Figure 2:
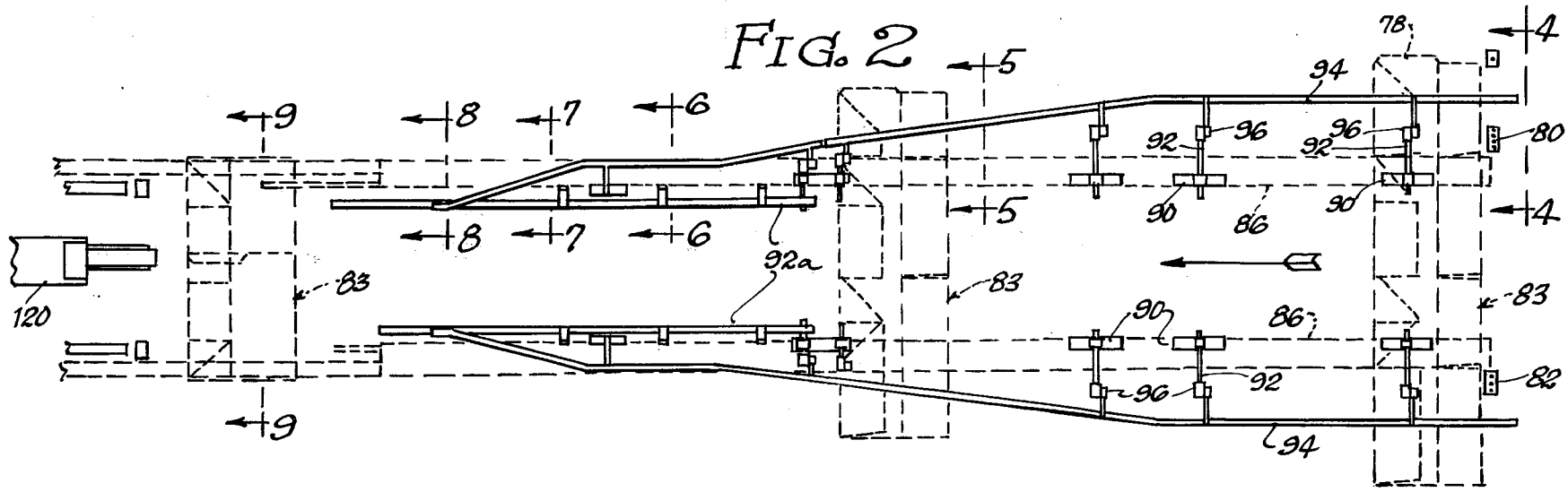
FIG. 2 is a plan view of the conveyor and rail mechanism according to the present invention.

Referring now to FIGS. 2–9, the conveyor and rail mechanism for performing the folding operations is illustrated. The conveyor and rail mechanism is disposed along the carton production assembly line directly after the glue-applying station. Referring to FIG. 2, the glue-applying devices are indicated schematically by the boxes 80, 82. A blank 83 enters the conveyor and rail mechanism 84 in the condition illustrated in FIG. 1-C. The cartons are conveyed through the mechanism by a pair of belt conveyors 86 disposed beneath the carton blanks. Disposed above the blanks are a series of skate wheel rollers 88 which maintain the carton in contact with the underlying belt conveyors.

A frame member is provided along the lengthwise extent of the rail mechanism and has supports 90 to which the skate wheels 88 are adjustably attached. Also attached to the frame members 90 is bifurcated support arm 92 to which a hold-down rail 94 is attached. A hold-down rail 94 is provided on both sides of the machine. The position of the hold-down rail 94 is altered for the specific carton to be processed by adjusting the pivot 96 of the bifurcated arm 92.

As indicated in FIG. 2, the conveyor belts 86 run the length of the rail mechanism. A flat member 92 is substituted for the skate wheels as the carton becomes sufficiently complete that there is no longer room to accommodate the wheels. A comparison of FIGS. 5 and 6 will indicate the change in structure.

Figures 3, 4, 5, 6, 7, 8, 9:
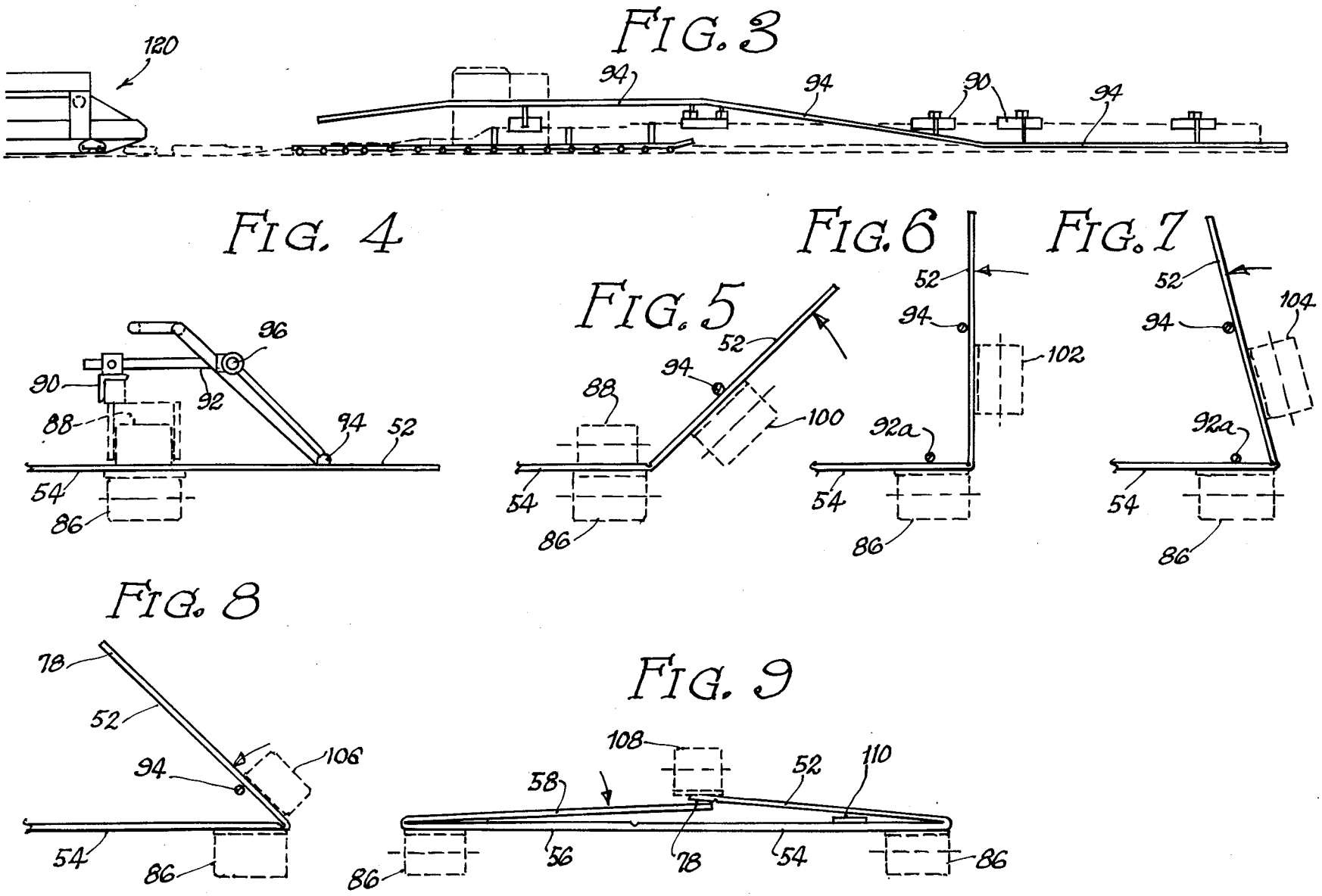
FIG. 3 is a side elevation of the conveyor and rail mechanism of FIG. 2.
FIGS. 4–9 are sectional views taken along the indicated section lines of FIG. 2, illustrating the action of the conveyor and rail mechanism.

The rails 94 extend substantially the length of the machine. At the incoming end of the convenyor the rails are at a level almost equal to the belt level on which the blanks are conveyed (FIG. 3). When the blank enters the device with its bottom flaps 64,67 folded over onto the panels 52,68, the hold-down rails 94 maintain the flaps in this position and prevent them from unfolding. The skate wheels 88 perform a similar function for the bottom flap 65,66.

As the carton blanks move through the rail and conveyor mechanism, the rails 94 move upwardly and inwardly to permit the panels 52,58 to fold over onto the panels 54,56, always assuring that the bottom flaps 64,67 cannot unfold prior to the panels 52,58 being joined.

The actual folding of the panels 52,58 is accomplished by a series of endless belt rollers 100, 102, 104, 106, and 108, illustrated in FIGS. 4–9. The first belt roller 100 causes the panels 52,58 to be bent upwardly to begin the folding operation. As indicated in FIG. 6, after the initial raising of the panels, a second belt roller 102 on either side of the device effects a further movement of the panel. Additional movement is caused by succeeding belt rollers until the panel 52 is substantially folded over onto the panel 54 and similarly for panels 52,58.

Finally, the manufacturer's flap 78 on panel 52 comes into proximity of the panel 58 and roller 108 is effective for completing the folding operation by pressing the manufacturer's flap 78 onto panel 58. As roller 108 presses the manufacturer's flap onto panel 58, the glue areas 74,76 on the blank contact the reversely folded triangular flaps 70,72. It will thus be appreciated that at the point indicated in FIG. 9, all that remains for the carton to be completed is for the applied adhesive to set.

Since the cartons are moved through the conveyor belts 86, the belt rollers 100–108 need not be motorized, although they can be if desired. As stated, as the carton comes into its folded position, there is not room to provide skate wheels 88 inside the blank since they would hamper the folding operation. Accordingly, when the blanks reach the point indicated by FIG.6 on the device, the rod-like member 92 is substituted for the rollers 88 until the blanks reach the point indicated by FIG. 8 where a flat blade-like member 110 is utilized for maintaining the panels 54,56 against the moving conveyor 86.

Summarizing the operation of the conveyor and rail mechanism, it will be appreciated that blanks are provided to the device, the panels of which already have had the necessary glue applied thereto. The conveyor mechanism moves the blank along the rail and belt structure such that the bottom flaps 64–67 are maintained in their folded condition while the end panels 52, 58 are folded over onto the center panels 54,56 causing the applied glue to contact the necessary sections of the panels to permanently bond the carton in its assembled condition.

After passing through the rail and conveyor system, it is necessary to compress the folded blank and maintain it in the compressed condition for a period of time sufficient to permit the applied glue to cure or set. For this purpose, center compression and side compression units are utilized. The center compression unit is illustrated in FIGS. 10–14.

Referring to FIG. 10, a center compression unit 120 is illustrated. The center compression unit receives the cartons as they are discharged from the rail and conveyor device of FIG. 2. The center compression device includes a lower conveyor belt 122 moved about rollers 124, 126 and an upper conveyor belt 128 disposed about rollers 130, 132. The cartons are received from the right end as viewed in FIG. 10 and are conveyed on the lower belt 122 through the center compression unit. The upper belt 128 is maintained in contact with the upper portion of the cartons as they pass through the unit by a series of spring-biased roller units 134 to be discussed subsequently. Thus the belt 128 is maintained in contact with the upper portion of the carton, and due to the roller units 134, apply pressure, transmitted through the belt, to the top of the cartons for the purpose of compressing them to spread the glue and permitting it to set. The center compression unit acts on the manufacturer's joint and the adhesive applied to the triangular flap portions.

The remaining portions of the carton are compressed by the side compression unit to be discussed subsequently. The various components of the center compression unit are mounted to a lower frame member 140 and an upper frame member 142, respectively, and the position of the belts 128, 122 and the rollers 134 are laterally adjustable to accommodate the position of the manufacturer's flap for different size and type of corrugated constructions.

Referring to FIG. 11, the manner in which the unit can be laterally adjusted is indicated more clearly. A pair of slots 144, 146 permit the center compression unit to be laterally positioned as necessary, after which it is tightened to prevent movement during operation of the device. The slots are provided in cross support members 148, 150 to which the frame members 142, 140 are attached.

Figure 13:
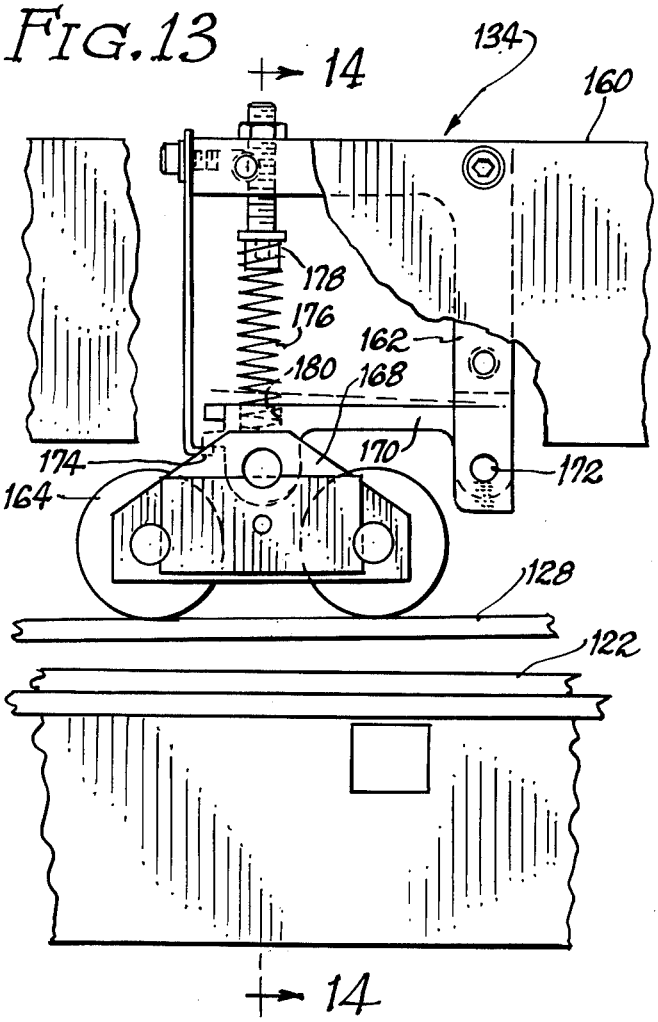
FIG. 13 is a side elevational view of an enlarged scale of one of the roller assemblies of the center compression unit.
Figure 14:
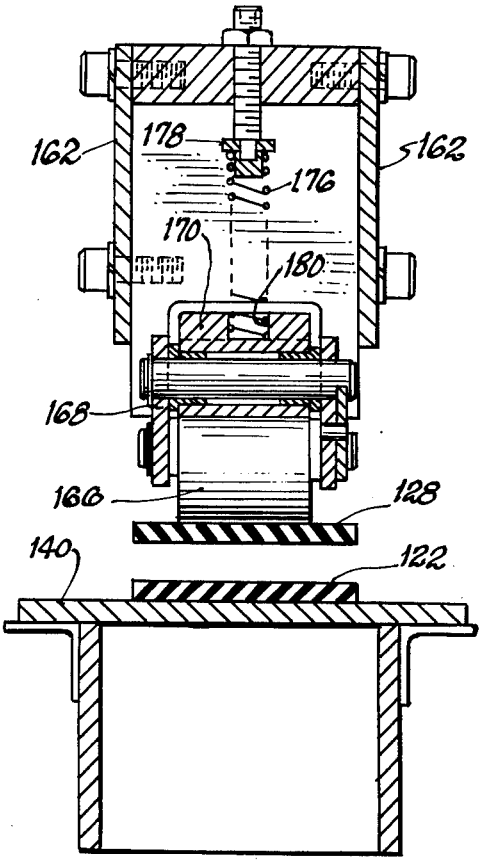
FIG. 14 is a sectional view along the lines 14—14 of FIG. 13.

Referring now to the FIGS. 13 and 14, the construction details of the spring-biased rollers 134 are illustrated. Each pair of rollers is attached to a cross member 160 forming part of the machine frame 142 by an angle bracket 162. The roller unit includes rollers 164, 166 rotatably mounted between a pair of triangular brackets 168. The brackets 168 are mounted to a pivot arm 170 which in turn is connected to the angle bracket 162 by means of a pin 172 about which the pivot arm 170 can rotate. In the absence of a spring bias the rollers 164, 166 will, by force of gravity, press downwardly against the upper belt 128 of the center compression unit to a maximum displacement permitted by the pivot arm 170 and a stop 174 provided to engage the pivot arm.

A spring bias arrangement is provided to control the amount of pressure which the rollers 164,166 exert against the belt 128 and includes a coil spring 176 attached to the L bracket 162 at its upper end by means of a screw insert 178. The lower portion of the spring is provided in an opening 180 in the pivot arm 170 directly above the connecting pivot to the triangular plate 168. When a carton passes through the center compression unit, its thickness tends to push the belt 128 upwardly against the force of the rollers 164,166. The rollers 164,166, due to the urging of the coil spring 176, provides a sufficient compressive force against the belt 128 to spread the glue and maintain the cartons in this compressed condition while the glue sets. After the cartons pass through the series of spring-biased rollers 134, they are conveyed by belts 122,128 to succeeding stations in the production line for performing any additional steps. In the production of automatic bottom cartons according to the patent referenced earlier, wherein an automatic bottom is employed, it is desirable to nest or stack the cartons in a manner to be shown and described in connection with FIGS. 20–22.

Figure 15:
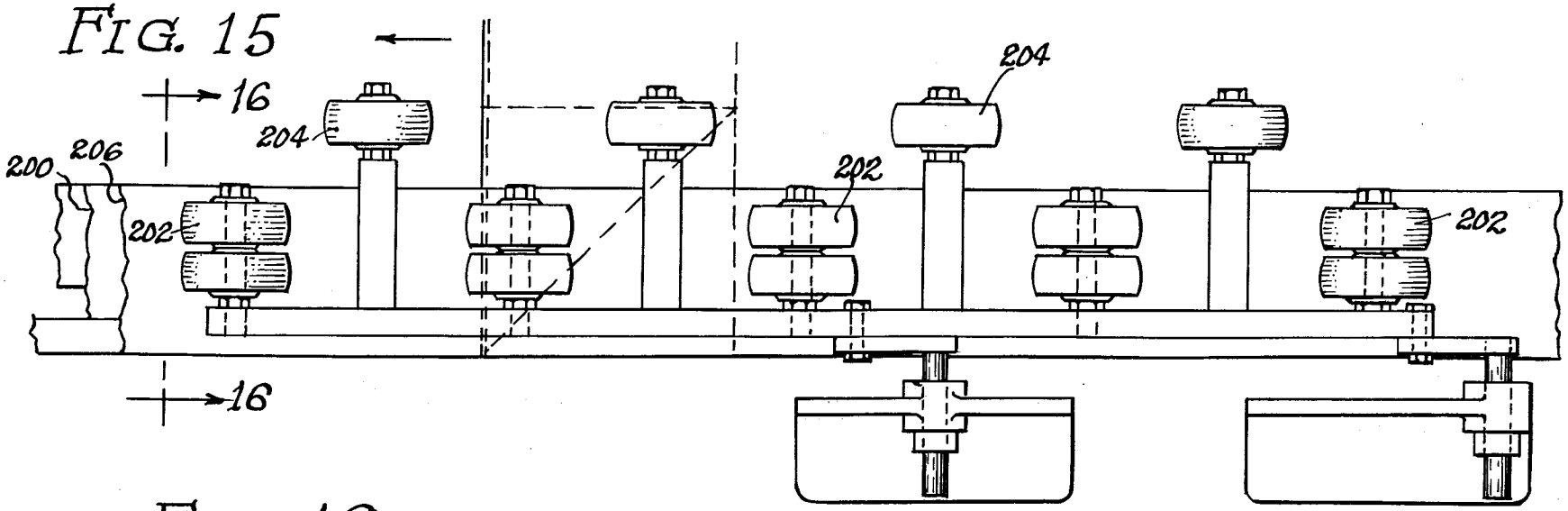
FIG. 15 is a plan view of the skate wheel conveyor according to the present invention.
Figure 16:
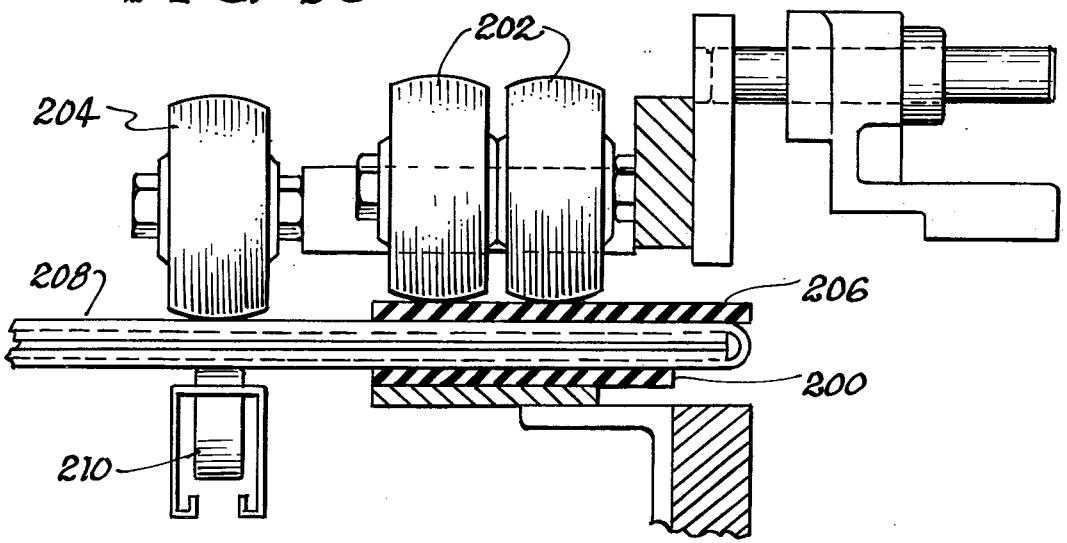
FIG. 16 is an end view along the lines 16—16 of FIG. 15.

Referring now to FIGS. 15 and 16, the skate wheel rollers according to the present invention are illustrated. The skate wheels are provided at various locations along the production line to compress and maintain in a compressed position the carton blanks. As already stated, these skate wheels are provided on the rail-conveyor mechanism. Referring to FIG. 15, there is illustrated in greater detail the skate wheel rollers according to the present invention are particularly adapted for uses after the cartons have passed through the center and side compression units. At such time the glue has nearly set and only moderate compressive force is required to permit completion of the process prior to stacking the containers. A single set of rollers are illustrated, but an identical set is provided for each side or the carton. The blank is conveyed through the skate wheel section on a belt 200. A plurality of skate wheels are provided along the path of the belt including roller pairs 202 and single rollers 204. The rollers 202 are attached to the machine frame from which they depend, and bear against an upper convenyor belt 206. As seen in FIG. 16, the conveyor belts 200 and 206 effect movement of the carton blank through the skate wheel section. The pairs 202 serving to maintain proper tension on the carton to prevent slippage, and maintain the cartons in a slightly compressed condition to insure proper setting of the adhesive. The wheels 204 are provided for a similar purpose but bear directly against the blank 208 at a location inwardly of the rollers 202. These wheels are positioned to press down the triangular flaps 70,72. Cooperating with the wheels 204 is a skid bar 210 which supports the underside of the blank 208.

The skate wheel sections illustrated in FIGS. 15 and 16 act to insure against inadvertent opening of cartons on which the glue has not set as quickly as anticipated.

Figure 17:
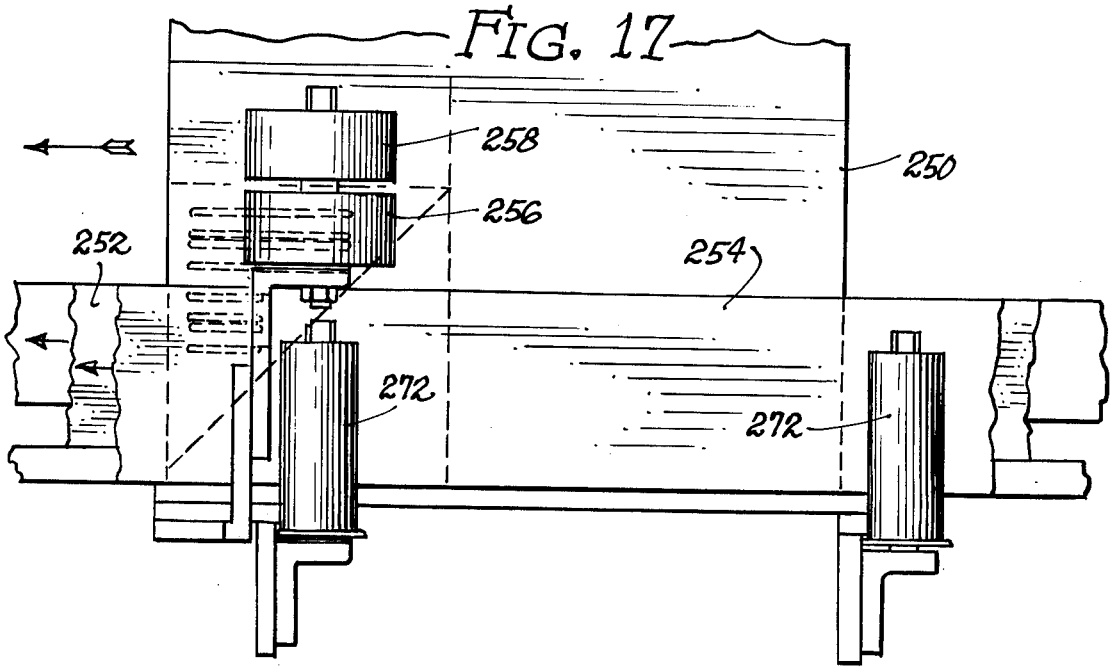
FIG. 17 is a plan view of the side compression unit.
Figure 18:
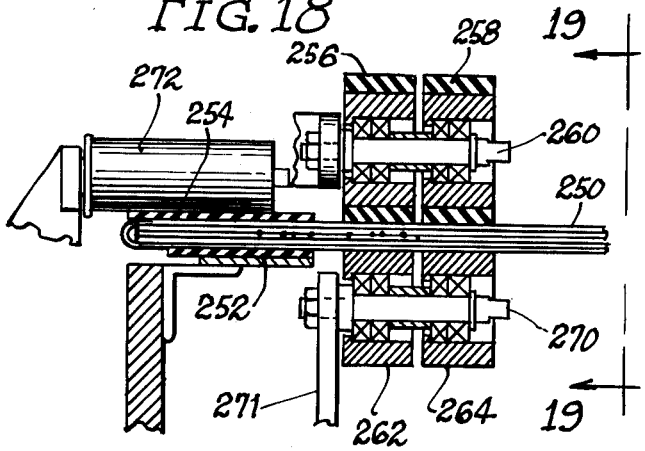
FIG. 18 is an end view of the side compression unit.
Figure 19:
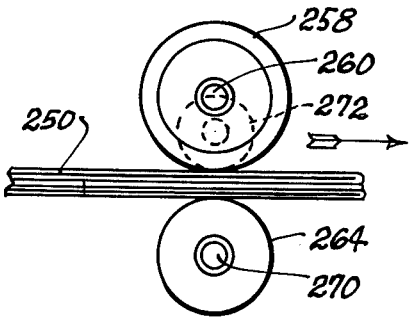
FIG. 19 is an end elevation of the side compression unit.

Referring now to FIGS. 17–19, a side compression unit according to the invention is illustrated. The side compression units are deployed on either side of the center compression unit so that as a carton which has been folded by the device of FIG. 2 passes into the center compression unit, it simultaneously is engaged by both sides compression units. The side compression unit employs two types of rollers for compressing the extremities of the carton blank. A first type of roller arrangement is effective for squeezing the adhesive applied to the blank to spread it in a thin, semi-uniform layer over a larger surface; while the second roller, in this case a bassic wheel, is effective for compressing the carton ends.

A blank 250 is moved through the center compression unit by the conveyor system previously described.

Cooperating with such conveyor system are an additional pair of belts 252, 254 deployed above and below the blank 250 and associated with the side compressive unit. Upper rollers 256, 258 are provided for spreading the glue which has been applied to the carton, particularly the glue on the reversely folded triangular flaps. Rollers 256, 258 are mounted to a shaft 260. Beneath the carton 250 are a corresponding pair of rollers 262, 264 which cooperate to compress the carton. The shaft 260 is eccentric and may be offset by an adjustable amount in order to compensate for wear and to adjust the pressure of these rollers. Thus, the compression of the rollers against the carton 250 can be adjusted and maintained within certain necessary limits by adjustment of the eccentricity of shaft 260. The lower rollers 262, 264 are mounted on a standard shaft 270 which is bolted to a portion of the frame 272. The upper rollers 256, 258 may have a rubber or other pliable material disposed around their circumference if desired. Disposed outwardly of the glue compression rollers 256, 258 is a bassic wheel or roller 272. The bassic roller is disposed above the belt 254 and applies pressure to the end of the blank 250 through the belt 254 in a manner similar to that described for the center compression unit. The bassic wheels are deployed along the length of the side compression unit for maintaining the ends of the blank 250 under sufficient compression to permit the glue to set. As will thus be apparent by referring to FIG. 17, after the rollers 256, 258 effect spreading of the glue, the bassic rollers 272 deployed along the length of the line, maintain the carton ends sufficiently compressed to permit glue setting.

The bassic wheels 272 are adjustable as to position and tension by means of a slot and bolt arrangement provided in the frame structure in a manner well known in the art. The rollers 256, 258, in addition to being adjustable by the eccentricity of shaft 260, can be positioned laterally in relation to the direction of movement of the conveyor belts so as to be directly over the area of heaviest glue application, depending on a particular type and size of carton being run on the device.

Figure 20:
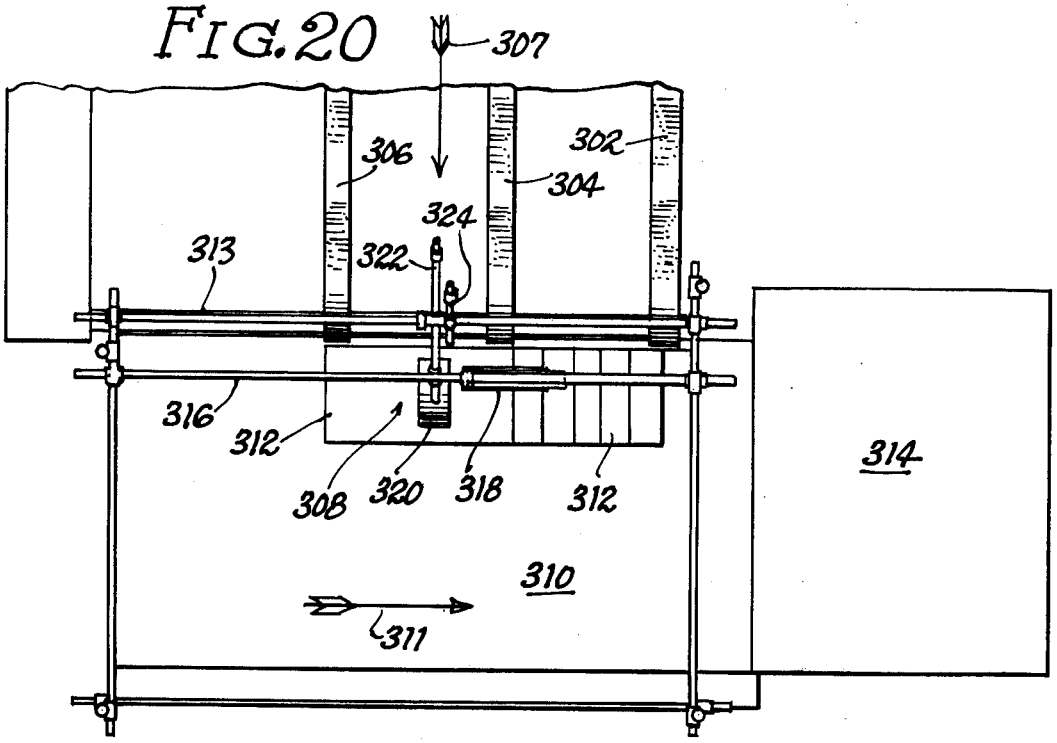
FIG. 20 is a plan view of the hold-down conveyor.
Figure 21:
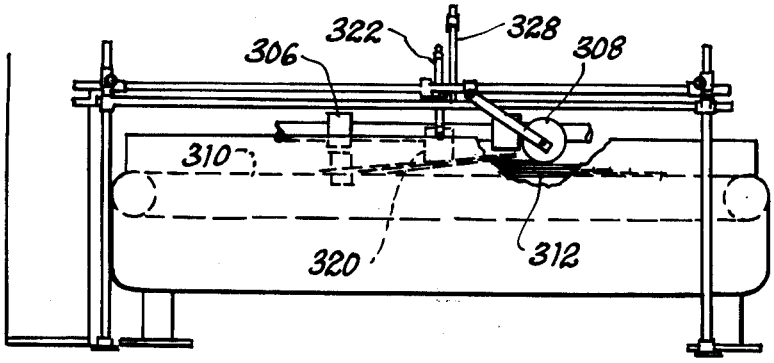
FIG. 21 is an end elevation of the hold-down conveyor.
Figure 22:
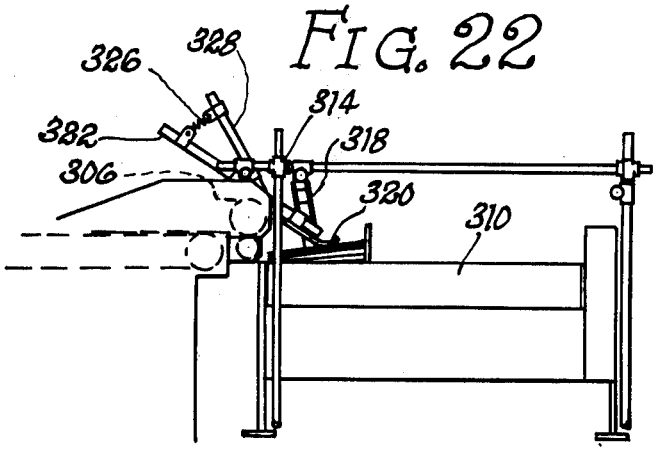
FIG. 22 is a side elevation of the hold-down conveyor.

Referring now to FIGS. 20–22, a stacker conveyor unit is illustrated. The stacker conveyor unit 300 is placed at the discharge end of the center compression unit illustrated in FIG. 10 and receives from the center compression unit cartons which have been completed. The cartons are supplied to the unit by conveyor belts 302 and 306 as indicated by the arrow 307. As the cartons come off of the conveyor belts, they pass under a hold-down shoe mechanism 308, to be described, which effects a stacking of the cartons in a manner best seen in FIG. 22. The stacked cartons are moved out of the vicinity of the hold-down shoe on a large belt conveyor 310 in the direction of arrow 311. Conveyor 310 conveys the completed and stacked cartons 312 to subsequent devices in the carton production line, such as a counter and bundling device which form no part of the present invention. Such additional units are indicated by the box 314 in FIG. 20.

The hold-down shoe 308 is mounted to a rectangular frame arrangement 314 on which the shoe is laterally positionable relative to the conveyor belts 302, 304 and 306. A second cross brace member 316 serves to mount a bassic wheel 318 which is similarly adjustable in lateral position.

The hold-down shoe 308 is spring-loaded and comprises an arcuate plate 320 mounted at the end of a shaft 322. The height of the plate 320 above the conveyor 310 is adjustable by means of a pin fitting 324.

As best seen in FIG. 22, the spring bias is provided on the arcuate plate 320 by means of a coil spring 326 attached at the upper end of shaft 322 and connecting that shaft to a fixed shaft 328. Thus, the lower end of shaft 322 is biased downwardly pressing the arcuate plate 320 against the conveyor 310 in the absence of cartons. It will be appreciated that as cartons pass off of the conveyors 302, 304, 306 they pass under the arcuate plate 320 and are retained there by the pressure of the spring 326. Subsequent cartons thus stack on top of the previous cartons in the manner illustrated in FIG. 20 with the arcuate plate 320 acting as a hold-down. The slower conveyor 310 moves the stacked cartons to the subsequent units on the production line.

While we have shown and described embodiments of this invention in some detail, it will be understood that this description and illustration are offered merely by way of example, and that the invention is to be limited in scope only by the appended claims.

We claim:

1. Apparatus for processing container blanks to which adhesive has been selectively applied, said blanks having inner and outer side panels and top and bottom flaps attached to each of said panels, comprising:

first means receiving said blanks for folding the outer side panels over onto the inner panels to join the outer side panels together along an adhesive bearing portion;

second means receiving the folded blanks from said first means for compressing the inner and outer side panels against each othe to permit the adhesive to set for permanently securing said outer panels one to the other.

third means for compressing said blank at predetermined locations to spread the applied adhesive thereover and to permit said adhesive to set, said third means including compression rollers disposed above and below the folded blank cooperating to compress the blank therebetween to spread the adhesive over the surface area of the blank subjected to said rollers.

2. The apparatus according to claim 1 wherein said third means includes:

a. basic wheels for compressing the ends of the folded blank.

3. The apparatus of claim 1 wherein said blanks have their bottom flaps folded over onto the side panels prior to being received by said first means and wherein said first means includes:

a. means for conveying said blanks therethrough;

b. a plurality of belt rollers positioned along the conveying means each causing a sequential movement of the outer panels from a flat position to the position overlying the inner panels;

c. adjustable hold-down rails on each side of said conveyor positioned to maintain contact with the folded bottom flaps of the outer panels to prevent unfolding of the bottom panels as said outer panels are moved to the overlying position.

4. The apparatus according to claim 3 further including skate wheels positioned along said first means for preventing unfolding of the bottom flaps of said inner panels.

5. The apparatus of claim 1 wherein said second means includes:

a. means for conveying said folded blanks through said second means including an upper conveyor belt; and b. means for pressing said upper belt against the folded blanks to maintaining contact therewith and for causing said compressing of said inner and outer side panels.

6. The device according to claim 5 wherein said means for pressing includes a plurality of resilient roller units spaced along the length of said upper conveyor belt.

7. The device according to claim 6 wherein said roller units are laterally adjustable to accommodate variations in blank dimensions.

8. The apparatus according to claim 6 wherein each of said roller units includes a pair of rollers mounted for rotation in a bracket and which press the upper conveyor belt against said blanks.

9. The apparatus according to claim 8 wherein said roller units include adjustable spring means for producing a selectable pressure on the upper belt.

10. The apparatus according to claim 2 wherein the compression rollers disposed above the folded blank are mounted on an adjustable eccentric shaft whereby adjustment of the pressure of said cooperating rollers on said blanks can be effected.

* * * * *